US005983865A

United States Patent [19]

Yamashita et al.

[11] Patent Number: 5,983,865

[45] Date of Patent: Nov. 16, 1999

[54] AIR-FUEL MIXTURE VALVE AND METHOD OF DETERMINING MAGNETIC FORCE OF ELECTROMAGNETIC COIL FOR OPENING THE AIR-FUEL MIXTURE VALVE

[75] Inventors: Hiroshi Yamashita; Minoru Ueda; Shunji Akamatsu, all of Saitama, Japan

[73] Assignee: Honda Giken Kogyo Kabushiki Kaisha, Tokyo, Japan

[21] Appl. No.: 09/082,121

[22] Filed: May 20, 1998

[30] Foreign Application Priority Data

May 23, 1997 [JP] Japan ..... 9-134163

[51] Int. Cl.[6] ..... F02M 67/02

[52] U.S. Cl. ..... 123/472; 123/531; 123/26

[58] Field of Search ..... 123/533, 531, 123/472, 471, 467, 26

[56] References Cited

U.S. PATENT DOCUMENTS

| | | | |
|---|---|---|---|
| 4,846,114 | 7/1989 | List | 123/26 |
| 4,892,065 | 1/1990 | List | 123/26 |
| 4,936,279 | 6/1990 | Ragg | 123/533 |
| 5,119,792 | 6/1992 | Gu | 123/533 |
| 5,671,715 | 9/1997 | Tsuzuki | 123/467 |
| 5,890,471 | 4/1999 | Nishimura | 123/467 |

FOREIGN PATENT DOCUMENTS

| | | |
|---|---|---|
| 0315328 | 5/1989 | European Pat. Off. . |
| 5-256230 | 10/1993 | Japan . |

*Primary Examiner*—Willis R. Wolfe
*Assistant Examiner*—Hieu T. Vo
*Attorney, Agent, or Firm*—Birch, Stewart, Kolasch & Birch, LLP

[57] ABSTRACT

In order to supply an air-fuel mixture composed of the fuel and compressed air to a combustion chamber of an engine, an air-fuel mixture valve is opened by a valve body which is moved via the core shifted by magnetic force of the electromagnetic coil. The invention provides a method of determining the magnetic force of the electromagnetic coil on the basis of the relationship defined by $Fm \geqq Fv - fa$, where Fm denotes axial tension depending upon the magnetic force of the electromagnetic coil, Fv denotes force necessary for opening or closing the empty air-fuel mixture valve, and fa denotes force for compressed air to open the air-fuel mixture valve. The pressure of the compressed air is used as the auxiliary force to open the air-fuel mixture valve. This allows the air-fuel mixture valve to be made more compact and reduces power consumption of the electromagnetic coil.

20 Claims, 8 Drawing Sheets

AIR-FUEL MIXTURE VALVE AND METHOD OF DETERMINING MAGNETIC FORCE OF ELECTROMAGNETIC COIL FOR OPENING THE AIR-FUEL MIXTURE VALVE

BACKGROUND OF THE INVENTION

1. Field of the Invention

The present invention relates to a method of determining a magnetic force of an electromagnetic coil in an air-fuel mixture valve which supplies an air-fuel mixture to a combustion chamber of an internal combustion engine.

2. Description of the Background Art

An air-fuel mixture valve is used to intermittently inject an air-fuel mixture to a combustion chamber of a two-cycle engine. An example of the air-fuel mixture valve is disclosed in Japanese Patent Laid-Open Publication No. Hei 5-256230, entitled "Fuel and Gas Mixing Unit". Referring to FIGS. 1 to 3 of the above publication, the gas and fuel mixing unit is an electromagnetic solenoid assembly in which the armature is moved by the magnetic force of the coil winding. The poppet valve is shifted via the armature to open a spherical valve, thereby supplying an air-fuel mixture to the combustion cylinder of the engine body. Specifically, the armature and the upper end of the poppet valve are integrally formed. The armature is moved upward by resilience of a coil spring while the coil winding remains unenergized, thereby closing the spherical valve. When the coil winding is energized, the armature is moved downward by the magnetic force of the coil winding against the resilience of the coil spring, thereby opening the spherical valve.

The foregoing electromagnetic solenoid assembly is designed so as to open the spherical valve only by the magnetic force of the coil winding when no air-fuel mixture is supplied. In other words, the assembly is designed such that predetermined valve lift can be assured when the orifice of the air-fuel mixture is at atmospheric pressure in the assembly. The assembly is inspected and then incorporated into an engine. In such an inspection, the assembly is checked to determine whether the spherical valve reliably opens and closes by energizing the coil winding when the engine body is not being supplied with an air-fuel mixture.

In order to obtain a higher output of two-cycle engines, an amount of the air-fuel mixture to be injected tends to be increased. To meet this requirement, the poppet valve has recently been enlarged, thereby increasing the valve lift, or an opening or closing stroke of the valve.

Specifically, the solenoid assembly has to double its output, which means enlargement of the coil winding. In other words, the larger the solenoid assembly, the greater power consumption. This is inevitable when the assembly is manufactured assuming that the conventional inspection method is applied.

SUMMARY OF THE INVENTION

It is therefore an object of the present invention to downsize an air-fuel mixture valve and reduce power consumption of the electromagnetic coil.

The present inventors have carefully studied the characteristics required for the air-fuel mixture valve to supply the mixture of compressed air and fuel to combustion chambers of the internal combustion engine, and propose to use the pressure of the compressed air as an auxiliary force.

Specifically, in the air-fuel mixture valve where the valve stem is caused to move via the core moved with magnetic force of the electromagnetic coil in order to open the air-fuel mixture valve and supply an air-fuel mixture to the combustion chambers of the internal engine, the invention provides a method of determining the magnetic force of the electromagnetic coil on the basis of the relationship defined by $Fm \geqq Fv - fa$, where Fm denotes axial tension depending upon the magnetic force of the electromagnetic coil, Fv denotes force necessary for opening or closing the empty air-fuel mixture valve, and fa denotes force for compressed air to open the air-fuel mixture valve.

The pressure of the compressed air is used as the auxiliary force to open the air-fuel mixture valve (i.e., to move the core in the direction for opening the valve), which leads to smaller magnetic force of the electromagnetic coil. The smaller the magnetic force, the smaller the electromagnetic coil. Therefore, the air-fuel mixture valve can be made compact and light in weight as a whole. Further, power consumption of the magnetic coil can be reduced, which enables the use of a smaller battery. Still further, circuits for controlling the activation of the electromagnetic coil and wiring for a power supply system can be reduced in size and made less expensive. When the electromagnetic coil is similar to a conventional one, driving force is increased by the auxiliary force, so that an open area of the air-fuel mixture valve can be increased and an amount of injected air-fuel mixture can be also increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
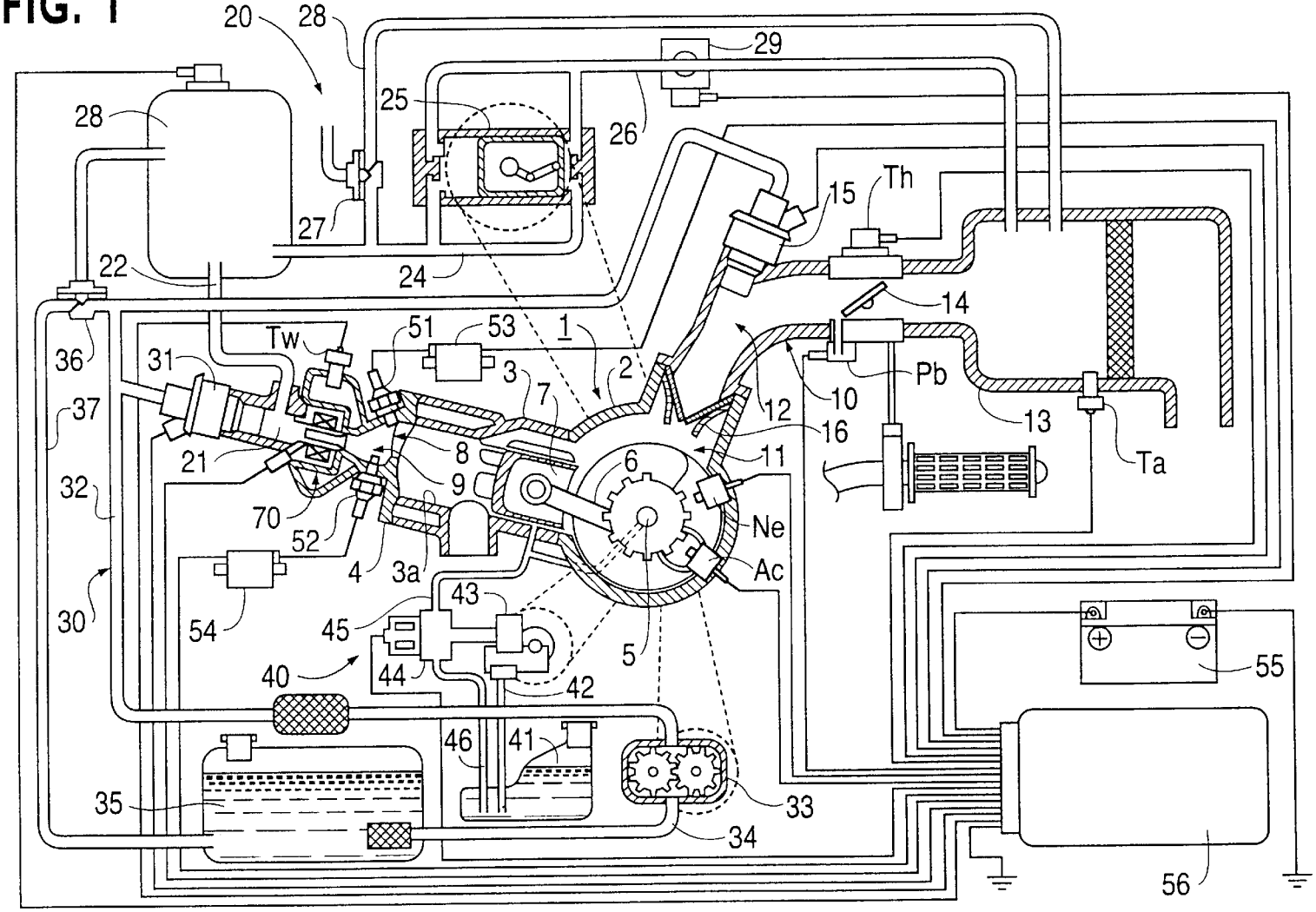
FIG. 1 is a schematic diagram showing the internal combustion engine incorporating the auxiliary combustion chamber according to the invention.

The invention will be described with reference to an embodiment shown in the accompanying drawings. FIG. 1 shows a fuel injected two-cycle internal combustion engine 1 which includes an auxiliary combustion chamber 9. The two-cycle engine may be installed on a scooter type motorcycle or the like (not shown). The engine 1 mainly includes a crankcase 2, a cylinder block 3, a cylinder head 4, a crankshaft 5, a connecting rod 6, and a piston 7.

The engine 1 further includes a main combustion chamber 8 communicating with the auxiliary combustion chamber 9 to which an air-fuel mixture valve 70 is attached. A main fuel injection valve (main injector) 31 is provided in an accumulator 21 above the air-fuel mixture valve 70. An air supply system 10 is provided for the auxiliary combustion chamber 9. The engine 1 further includes a compressed air supply system 20, a fuel supply system 30, and a lubrication oil supply system 40.

The air supply system 10 for the auxiliary combustion chamber includes an air cleaner 13 communicating with a crank chamber 11 in the crankcase 2 via an air charging passage 12, a throttle valve 14 positioned between upstream and downstream parts of the air charging passage 12, an auxiliary fuel injection valve (auxiliary injector) 15, and a reed valve 16. All of these members are arranged in the foregoing order. As the piston 7 moves upward to evacuate the crank chamber 11, air is introduced into the air charging passage 12 via the air cleaner 13 and is further introduced into the crank chamber 11 via the reed valve 16. The auxiliary fuel injection valve 15 injects the fuel when the internal combustion engine 1 is started or when lubrication oil is necessary.

The compressed air supply system 20 includes a surge tank 23 communicating with the accumulator 21 via an air pipe 22. The surge tank 23 is connected to the air cleaner 13 via an air discharge pipe 24, an air pump 25 and an air intake pipe 26. Following the rotation of the crankshaft 5, the air pump 25 is activated to compress air in the air cleaner 13 so that the compressed air is supplied to the surge tank 23 and is then transferred to the accumulator 21. An air pressure regulating valve 27 is supplied for maintaining the compressed air at a predetermined pressure in the surge tank 23 and the air discharge pipe 24. An air returning pipe 28 and a stop valve 29 are also provided.

The fuel supply system 30 includes a fuel tank 35 which is connected to the main and auxiliary fuel injection valves 31 and 15 via a fuel injection pipe 32, a fuel pump 33 and a fuel intake pipe 34. As the crankshaft 5 rotates, the fuel pump 33 is activated to supply the fuel from the fuel tank 35 to the main and auxiliary fuel injection valves 31 and 15. A fuel pressure regulating valve 36 is provided for maintaining the fuel within the fuel injection pipe 32 at a predetermined pressure, and a fuel returning pipe 37 is also provided.

The lubrication oil supply system 40 supplies lubrication oil to sliding parts of the engine 1. The lubrication oil supply system 40 includes a lubrication oil tank 41, a lubrication oil pipe 42, a lubrication oil pump 43, a lubrication oil control valve 44 and a lubrications oil supply pipe 45. Following the rotation of the crankshaft 5, the lubrication oil pump 43 is activated to provide the sliding parts of the engine 1 with an amount of lubrication oil determined by the lubrication oil control valve 44. A lubrication oil return pipe 46 is provided for returning lubrication oil to the tank 41.

An electronic control apparatus 56 is additionally provided to the two-cycle internal combustion engine 1. The electronic control apparatus 56 uses a battery 55 as the power supply. The electronic control apparatus 56 receives input signals from a sensor Ne to detect the number of rotations of crankshaft 5, a crank angle sensor Ac to detect the crank angle, a throttle opening sensor Th to detect an opening of a throttle, a temperature sensor TA to detect the ambient air temperature, a pressure sensor PB to detect the inlet pressure downstream of the throttle valve 14, and a temperature sensor Tw to detect the temperature of cooling water of the engine.

The engine is also provided with a main spark plug 51 for the main combustion chamber 8 and an auxiliary spark plug 52 for the auxiliary combustion chamber 9. The spark plugs 51, 52 are respectively provided with ignition coils 53, 54. An output terminal of the electronic control apparatus 56 is respectively connected to the fuel injecting valves 15, 31, the ignition coils 53, 54 and the lubricant control valve 44.

Figure 2:
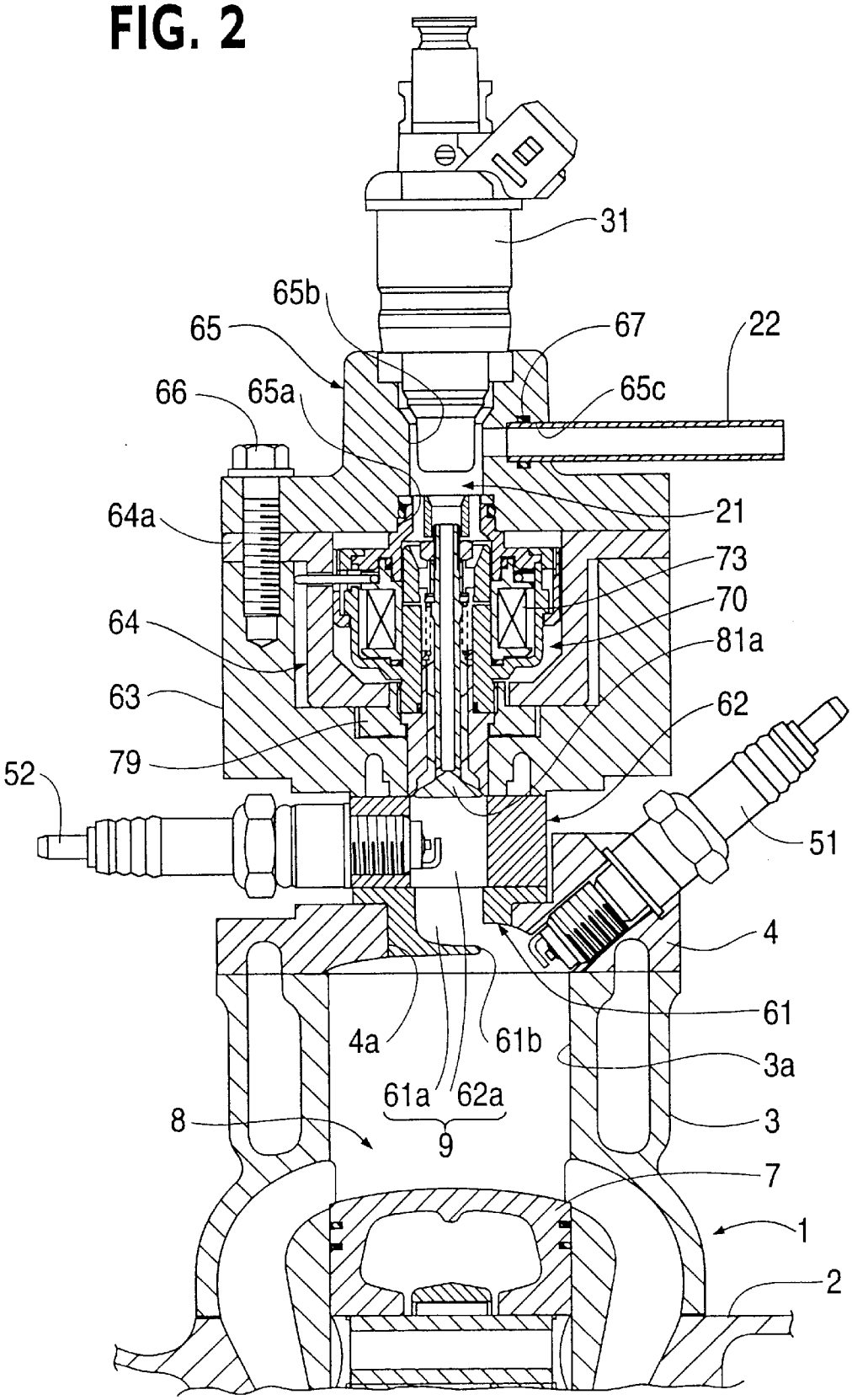
FIG. 2 is a cross-sectional view of the main part of the engine, showing the main and auxiliary combustion chambers.

FIG. 2 is a cross sectional view of the main part of the engine around the main and auxiliary combustion chambers to which the present invention is applied. To simplify the description, the engine 1 is depicted to be arranged in the direction of FIG. 2 (i.e. the upper part of FIG. 2 corresponds to the upper part of the engine 1).

In the engine 1, the main combustion chamber 8 is present at an upper part of a cylinder 3*a* of the cylinder block 3 at a position opposite to an exhaust port (not shown). The auxiliary combustion chamber 9 is positioned in the cylinder head 4 to communicate with the main combustion chamber 8. The air-fuel mixture valve 70 and the auxiliary spark plug 52 are attached to an end of the auxiliary combustion chamber 9 in order to inject the air-fuel mixture. The main fuel injecting valve 31 is disposed in the accumulator 21 above the air-fuel mixture valve 70. The main spark plug 51 for the main combustion chamber 8 is attached to the cylinder head 4.

The cylinder head 4 has a through-hole 4*a* formed at the center of the cylinder 3*a*. A lower casing 61 is fitted in the through-hole 4*b*. An upper casing 62 is placed on the lower casing 61 and is fixed to the cylinder head 4 together with the lower casing 61.

The lower casing 61 defines a space 61*a* and includes a communicating part 61*b* which is formed by cutting a part of a wall of the lower casing 61 and which communicates with the main combustion chamber 8. The upper casing 62 defines a space 62*a* and has the auxiliary spark plug 52 attached therewith. The spaces 61*a* and 62*a* communicate with each other to constitute the auxiliary combustion chamber 9.

In order to attach the air-fuel mixture valve 70 to the upper part of the auxiliary combustion chamber 9, a box-shaped stand 63 having an open top is attached to an upper end of the upper casing 62. A valve box 64 having an open top is inserted into the stand 63. A flange 64*a* of the valve box 64 is placed on the stand 63, and a cover 65 is placed on the valve box 64 in order to close the open top of the valve box 64. The stand 63, flange 64*a* and cover 65 are fastened using a bolt 66, thereby housing the air-fuel mixture valve 70 in the valve box 64.

The air-fuel mixture valve 70 has its bottom extending through the bottoms of the stand 63 and the valve box 64 such that a valve body 81*a* faces the auxiliary combustion chamber 9 (the upper end of the space 62*a* of the upper casing 62). The air-fuel mixture valve 70 is attached with its lower flange 79 sandwiched between an inner bottom of the stand 63 and a rear surface of the valve box 64, and with its upper end fitted into a stepped opening 65*a* on a rear surface of the cover 65.

The cover 65 has a through-hole 65*b* at the upper end of the stepped opening 65*a* to constitute the accumulator 21. The accumulator 21 is formed with a pipe attaching opening 65*c* on one side thereof. The main fuel injection valve 31 is attached to the upper end of the accumulator 21, while an air intake pipe 22 is attached in the pipe attaching opening 65*c*, with an O-ring 67 located between the air intake pipe 22 and the pipe attaching opening 65*c*.

Figure 3:
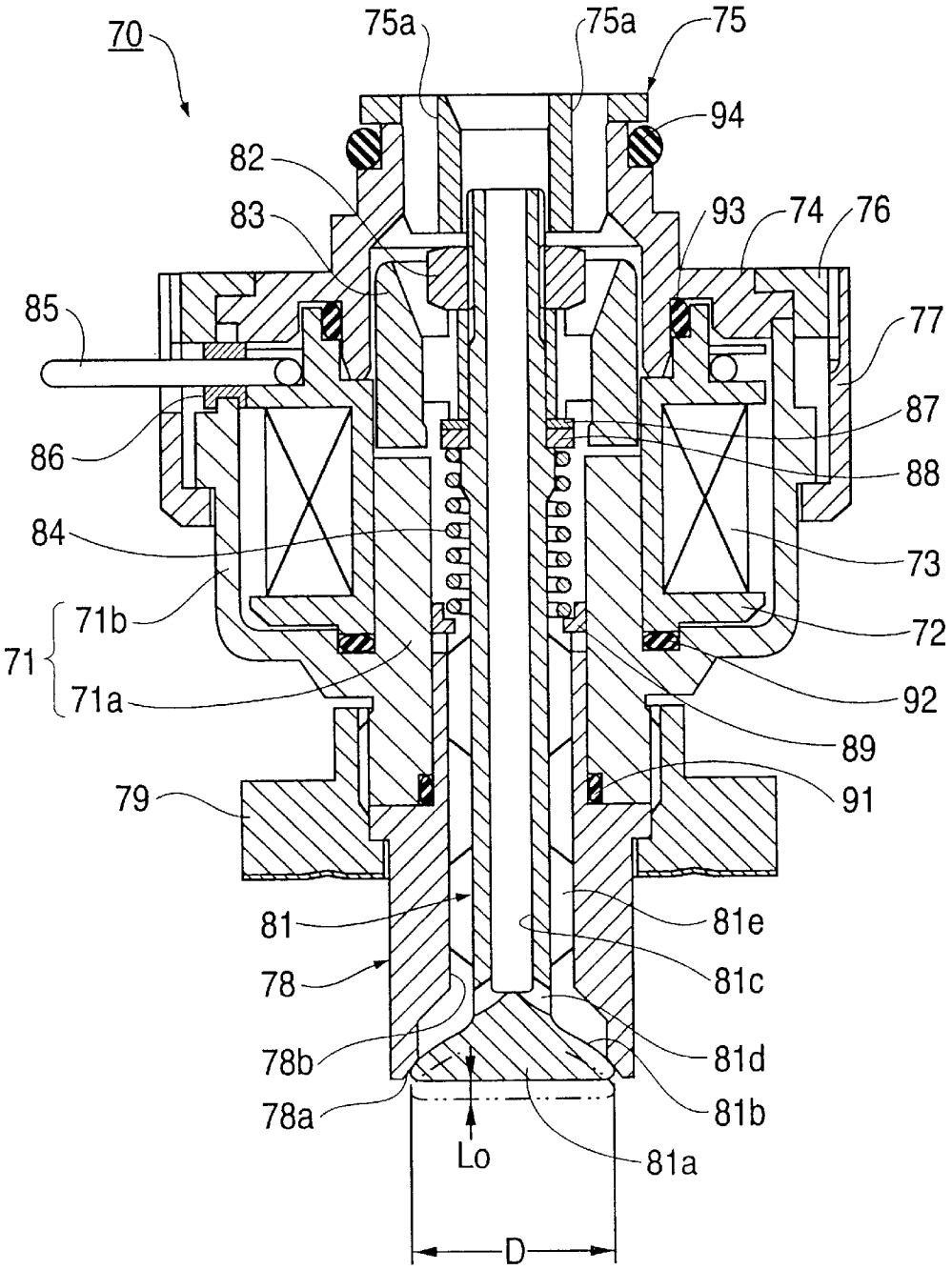
FIG. 3 is a cross-sectional view of the air-fuel mixture valve according to the invention.

FIG. 3 is a cross-sectional view of the air-fuel mixture valve according to the invention.

The air-fuel mixture valve 70 is a solenoid poppet valve, and is opened when a core 83 is moved by the magnetic force of the electromagnetic coil 73 in order to axially shift the valve stem 81 via the core 83.

The air-fuel mixture valve 70 includes a housing 71 with inner and outer cylinders 71*a* and 71*b*. A coil bobbin 72 is fitted between the inner and outer cylinders 71*a* and 72*b* of the housing 71. The electromagnetic coil 73 is wound around the coil bobbin 72. A disc-shaped lid 74 having an opening therein is attached to the upper part of the housing 71 to cover the coil bobbin 72 and the electromagnetic coil 73. A cylindrical cap 75 with a flange is engaged with the upper end of a projecting part of the lid 74. The cap 75 has a plurality of gas holes 75*a* formed along a periphery thereof. An annular adapter bolt 76 and a stepped nut 77 sandwich and threadably secure the housing 71 and the lid 74 from upper and lower sides thereof.

A stepped cylindrical valve seat 78 is fitted in the inner cylinder 71*a* to be in contact with the bottom of the inner cylinder 71*a*. A lower flange 79 is threadably attached into the inner cylinder 71*a* to bring the valve seat 78 into pressure contact with the bottom of the inner cylinder 71*a*. The valve stem (valve rod) 81 with the valve body 81*a* is fitted in the inner cylinder 71*a* and the valve seat 78 in order to be axially movable. The core 83 is engaged with the top of the valve stem 81 and fastened by a nut 82. A spring 84 urges the valve stem 81 and the core 83 in the direction for the valve body 81*a* to open the air-fuel mixture valve 70.

The valve seat 78 has a tapered valve seat face 78*a*. The valve stem 81 is integrally former with the valve body 81*a*, which has a tapered upper surface 81*b*. The tapered surface 81*b* functions as a valve face, and comes into and out of contact with the valve seat face 78*a* in order to open and close the air-fuel mixture valve 70. With this air-fuel mixture valve 70, the valve seat 78 has a diameter of 6 to 10 mm, and a lift (open/close stroke) $L_o$ of the valve body 81*a* is 0.3 to 0.6 mm, thereby increasing an open area of the air-fuel mixture valve 70.

The core 83 is axially movable in an opening of the coil bobbin 72 projecting upward from the inner cylinder 71*a*, and an opening on the lid 74. The spring 84 is a return spring such as a compression spring or the like.

As shown in FIG. 3, the air-fuel mixture valve 70 further includes an electromagnetic coil terminal 85, a terminal grommet 86, a washer 88, a spring receptacle 89 mounted atop the valve seat 78, and O-rings 91 to 94.

Figure 4:
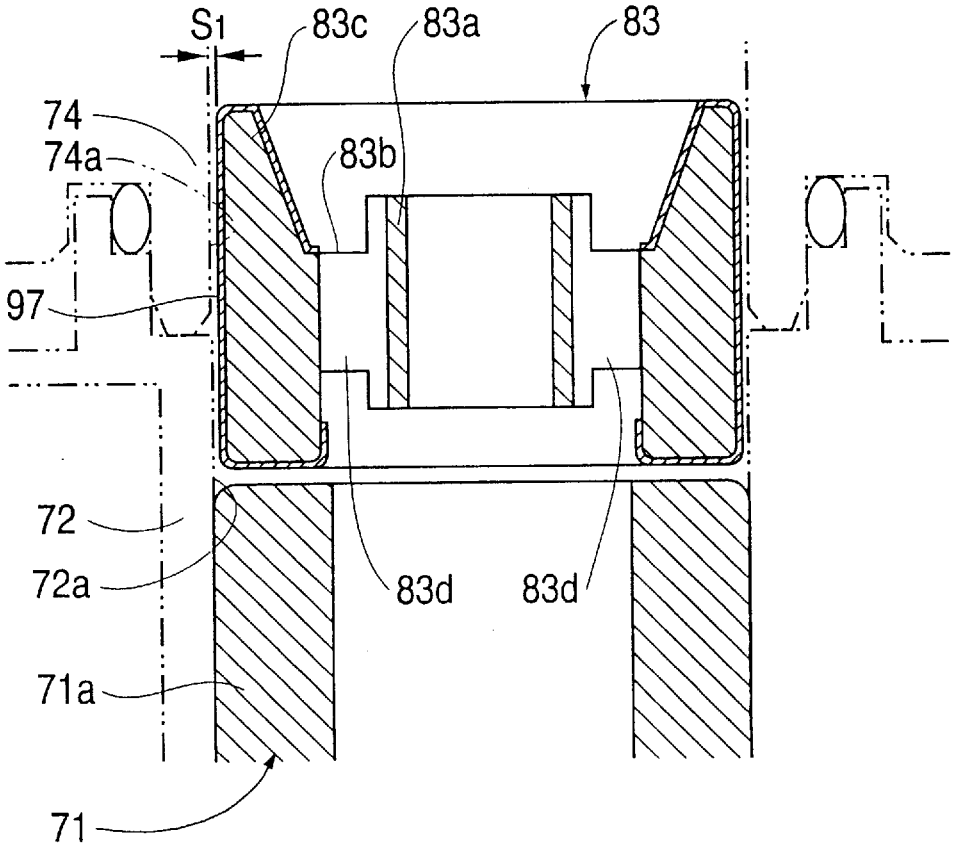
FIG. 4 is a cross-sectional view of the core according to the invention.

FIG. 4 is a cross sectional view of the core according to the invention. The core 83 includes a boss 83*a* attached to the valve stem 81 (refer to FIG. 3), a rim 83*b*, and a core part 83*c*, and is made of a magnetic material such as electromagnetic soft iron or the like. The foregoing members are formed as one component.

The core 83*c* has its surface (at least the outer surface) covered with a film 97 having a low frictional resistance. Specifically, the film 97 is made of fluorine group resin such as tetrafluoroethylene (trade name: TEFLON). A clearance $S_1$ between the core 83*c* covered with the film 97, the opening 72*a* of the coil bobbin 72, and the opening 74*a* of the lid 74 is approximately 150 $\mu$m, so that the core 83 can axially and smoothly slide in the openings 72*a* and 74*a*.

Figure 5:
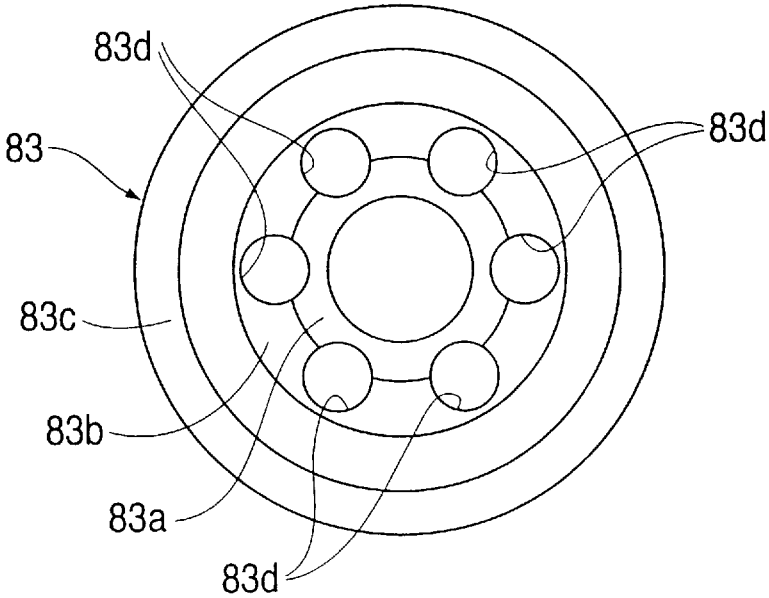
FIG. 5 is a top plan view of the core.

FIG. 5 is a top plan view of the core 83, showing a plurality of gas openings 83*d* extending through the rib 83*b* of the core 83.

Figure 6:
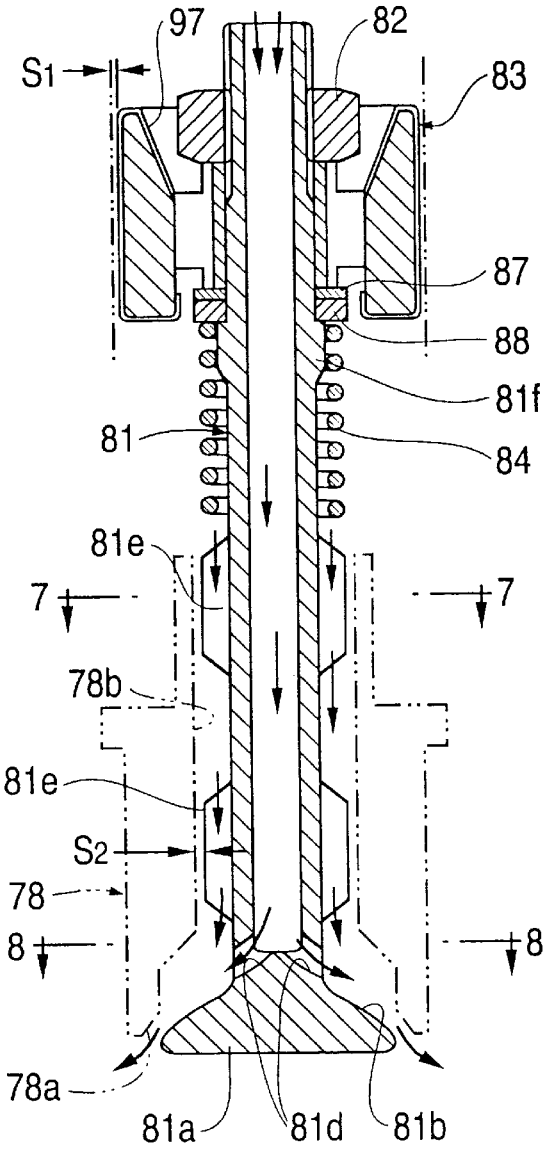
FIG. 6 is a cross-sectional view of the valve stem of the invention.

FIG. 6 is a cross-sectional view of the valve stem according to the invention. The valve stem 81 is substantially tubular, and has a gas opening 81*c* extending near the upper end of the valve body 81*c*, and a plurality of discharge openings 81*d* (see FIG. 8) which extend from the bottom of the gas opening 81*c* substantially along the upper surface 81*b* of the valve body 81*a*.

The valve stem 81 is provided with upper and lower guides 81*e* guided in the opening 78*b* of the elongate tubular valve seat 78, and a step 81*f* determining an axial position of the core 83. A clearance $S_2$ between the opening 78*a* of the valve seat 78 and the guides 81*e* is approximately 15 $\mu$m. The clearances $S_1$ and $S_2$ enable the valve stem 81 to move smoothly in the axial direction without twisting.

Figure 7:
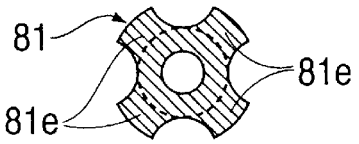
FIG. 7 is a cross-sectional view of the core, taken along line 7—7 in FIG. 6.

FIG. 7 is a cross-sectional view of the valve stem, taken along line 7—7 in FIG. 6. Four guides 81*e* are formed along the periphery of the valve stem 81.

Figure 8:
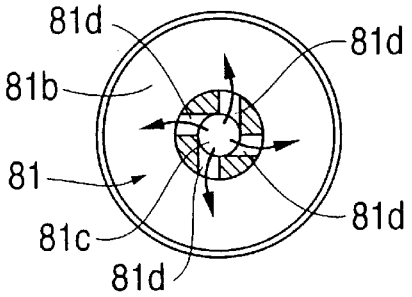
FIG. 8 is a cross-sectional view of the core, taken along line 8—8 in FIG. 6.

FIG. 8 is a cross sectional view of the valve stem 81, taken along line 8—8 in FIG. 6. The gas opening 81*c* is formed at the center of the valve stem 81, and the four discharge openings 81*d* are formed at positions offset from the center of the valve stem 81. The discharge openings 81*d* extend substantially on the upper surface 81*b* of the valve body 8*a*, and are present at positions offset from the center of the valve stem 81, so that the air-fuel mixture is injected in a spiral stream into the auxiliary combustion chamber 9 (shown in FIG. 2). Therefore, the air-fuel mixture in the spiral stream can blow off deposits (burnt waste containing carbon and cinders) which stick onto the valve seat 78*a*, and the upper surface 81*b* of the valve body 81 when the air-fuel mixture is burnt.

The valve body 8 la itself is rotated by the spiral stream of air-fuel mixture 70, thereby removing deposits sticking thereto. As a result, it is easily possible to remove the deposits sticking to the air-fuel mixture valve regardless of a combustion state in the auxiliary combustion chamber 9. Further, since the air-fuel mixture is blown spirally out of the discharge openings 81*d*, a mixing of the fuel and the compressed air is promoted, and combustion efficiency is improved.

Figure 9:
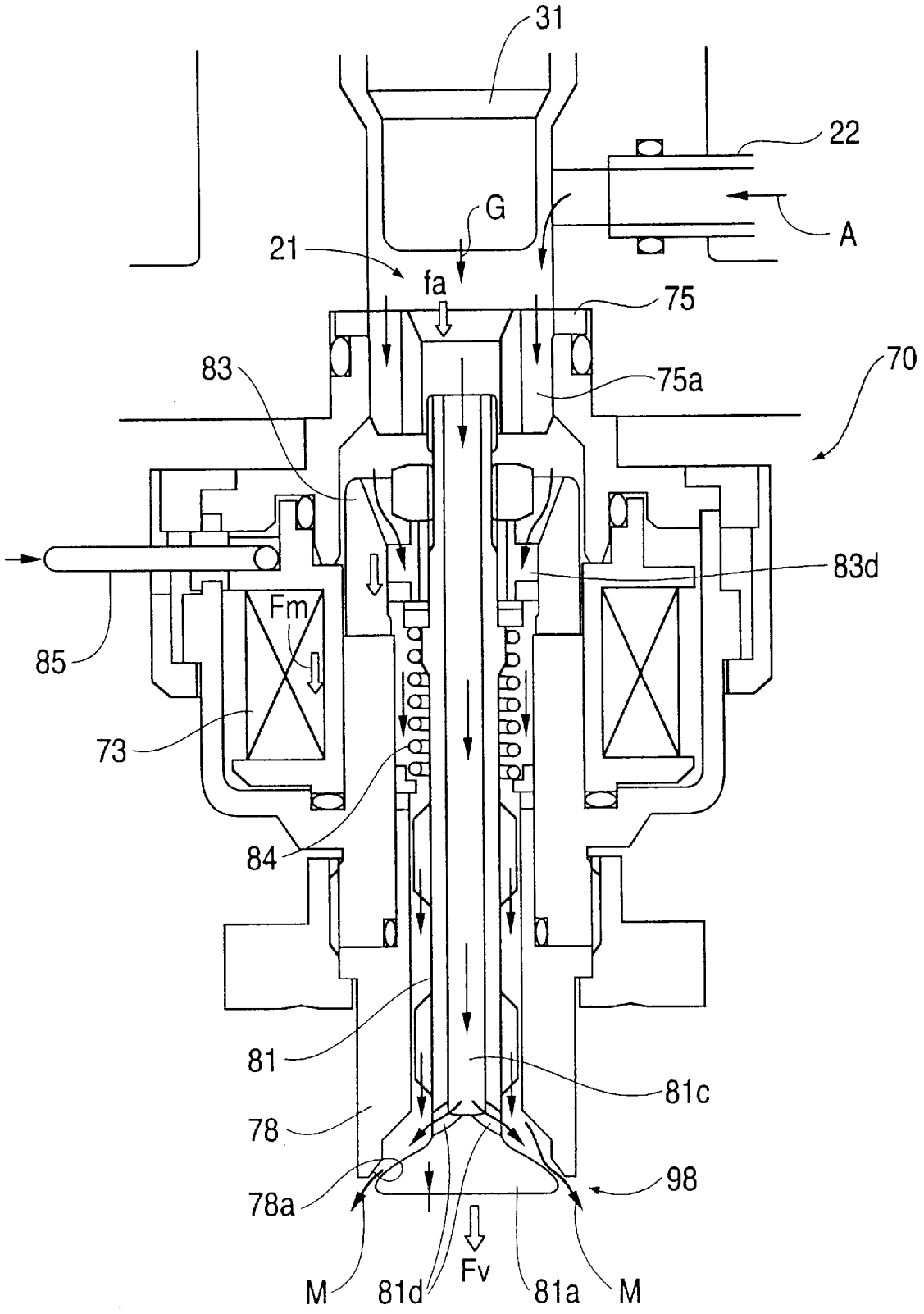
FIG. 9 shows the operation of the air-fuel mixture valve of the invention.

The operation of the air-fuel mixture valve 70 will be described with reference to FIG. 9. With the air-fuel mixture valve 70 closed, the fuel G is injected into the accumulator 21 via the main fuel injection valve 31. Compressed air A is supplied to the accumulator 21 via the air pipe 22. In this state, electric power is supplied to the terminal 85 in order to energize the electromagnetic coil 73, which makes the core 83 descend due to the magnetic force. As a result, the core 83 and the valve stem 81 are moved downward together, so that the valve body 81*a* moves away from the valve seat face 78*a* to open the air-fuel mixture valve 70. Thereafter, the air-fuel mixture M containing the fuel G and the compressed air A in the accumulator 21 is injected into the auxiliary combustion chamber 9 (FIG. 2) via the gas opening 81*c* and discharge openings 81*d* of the valve stem 81 and via the gas openings 75*a* on the cap 75, gas openings 83*d* of the core 83, the clearance around the valve stem 81, and the valve opening 98.

A method of determining the magnetic force of the electromagnetic coil 73 will be described referring to FIG.

9. The magnetic force of the electromagnetic coil 73 is preferably determined on the basis of the relationship represented by the formula (1).

$$Fm \geqq Fv - fa \quad (1)$$

where Fm is an axial force caused by the magnetic force of the electromagnetic coil 73, Fv is a force necessary for opening and closing the air-fuel mixture valve 70 which is empty (i.e., when no air-fuel mixture M is supplied thereto), and fa is a force for the compressed air A to open the air-fuel mixture valve 70.

The core 83 is moved to open the air-fuel mixture valve 70 with the magnetic force which is determined on the basis of the formula (1) by energizing the electromagnetic coil 73 with the compressed air A supplied. As a result, the valve body 81*a* is operated to open the air-fuel mixture valve 70. Therefore, the magnetic force of the electromagnetic coil 83 may be determined to satisfy the relationship defined by formulas (2) and (3).

$$Fm + fa > Fv > Fm \quad (2)$$

$$Fv > fa \quad (3)$$

In other words, the foregoing relationship defined by the formulas (2) and (3) is used to determine the magnetic force of the electromagnetic coil 73 in order to open the air-fuel mixture valve 70 using the pressure of the compressed air A as the auxiliary force.

The use of the compressed air A as the auxiliary force results in the reduction of the magnetic force of the electromagnetic coil 73. The smaller the magnetic force, the smaller the electromagnetic coil 73, and the less power consumption thereof.

The compressed air A has the predetermined pressure which is above the atmospheric pressure. The pressure is appropriately determined considering the following conditions (a) to (f) and so on, and is approximately 1 to 3 kg/cm$^2$G.

(a) Lift of the valve body 81*a;*

(b) Diameter of the air-fuel mixture valve;

(c) Area for receiving the pressure of the compressed air A necessary to open the air-fuel mixture valve 70;

(d) Back pressure applied from the auxiliary combustion chamber 9;

(e) Frictional resistance of the valve stem 81 and the core 83; and (f) Load applied to the spring 84.

The results of experiments performed for the foregoing air-fuel mixture valve 70 will be described with reference to FIGS. 10 and 11.

Figure 10A:
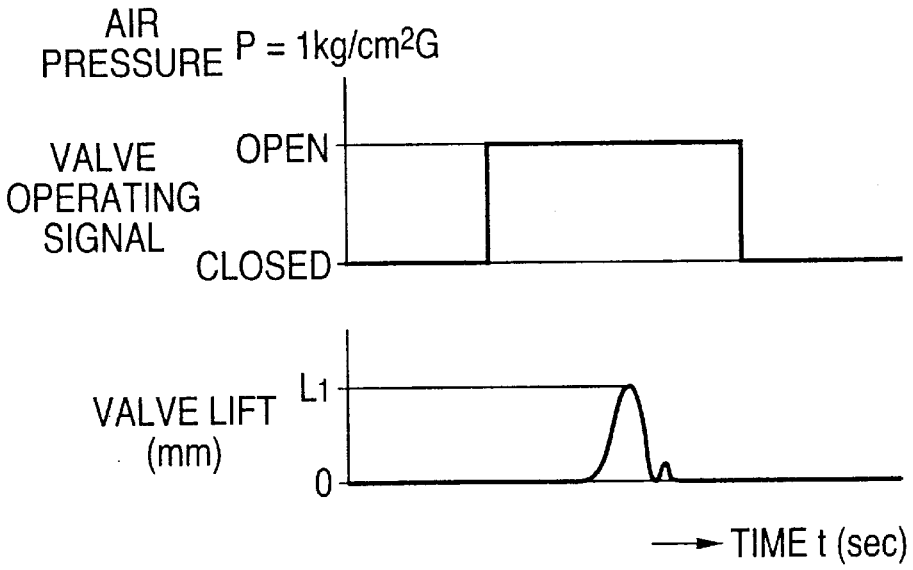
FIGS. 10(*a*) and 10(*b*) are graphs showing the lift waveform of the valve body of the air-fuel mixture valve.
Figure 10B:
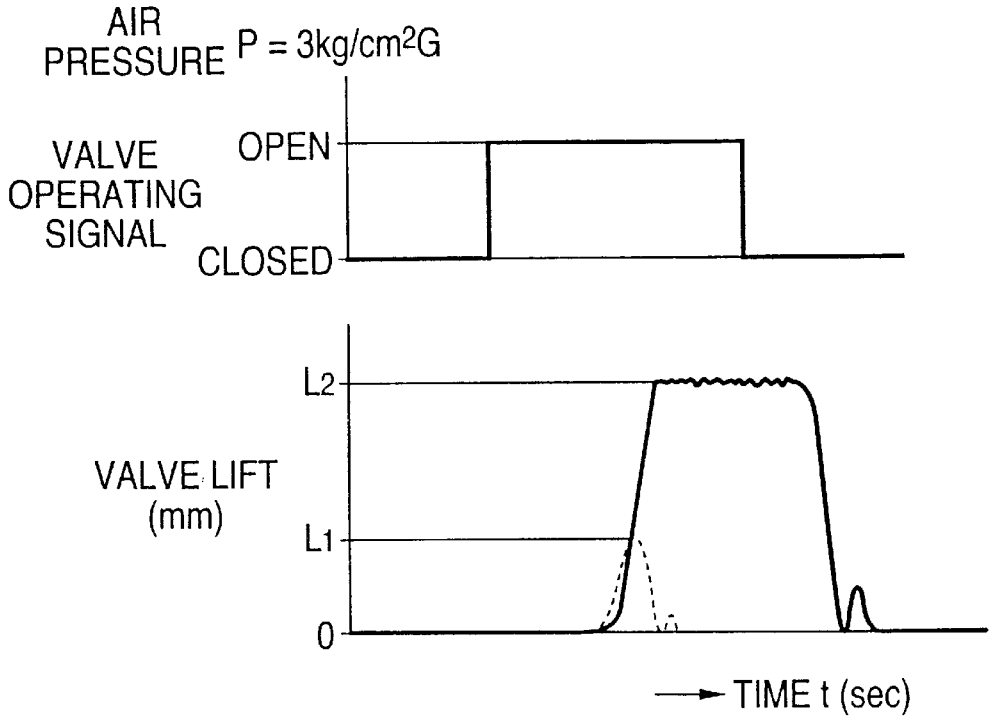

FIGS. 10(*a*) and 10(*b*) are a first set of graphs showing the lift waveform of the valve body of the air-fuel mixture valve of the invention. In these figures, the abscissa denotes time t (seconds) while the ordinate denotes the lift of the valve body. FIG. 10(*a*) shows the lift waveform when the pressure P of the compressed air is 1 kg/cm$^2$G, and FIG. 10(*b*) shows the lift waveform when the pressure P is 3 kg/cm$^2$G.

Referring to FIG. 10(*a*), the maximum lift of the valve body is $L_1$ (mm) when the electromagnetic coil 73 is energized in response to a valve operating signal to open the air-fuel mixture valve. This lift is not sufficient to open the air-fuel mixture valve reliably.

In FIG. 10(*b*), the maximum lift of the valve body is $L_2$ (mm) when the electromagnetic coil 73 is energized in response to the valve operating signal to open the air-fuel mixture valve. This lift is sufficient to open the air-fuel mixture valve reliably.

It has been confirmed that the air-fuel mixture valve 70 is not opened at all when the pressure P of the compressed air is 0 kg/cm$^2$G.

Figure 11A:
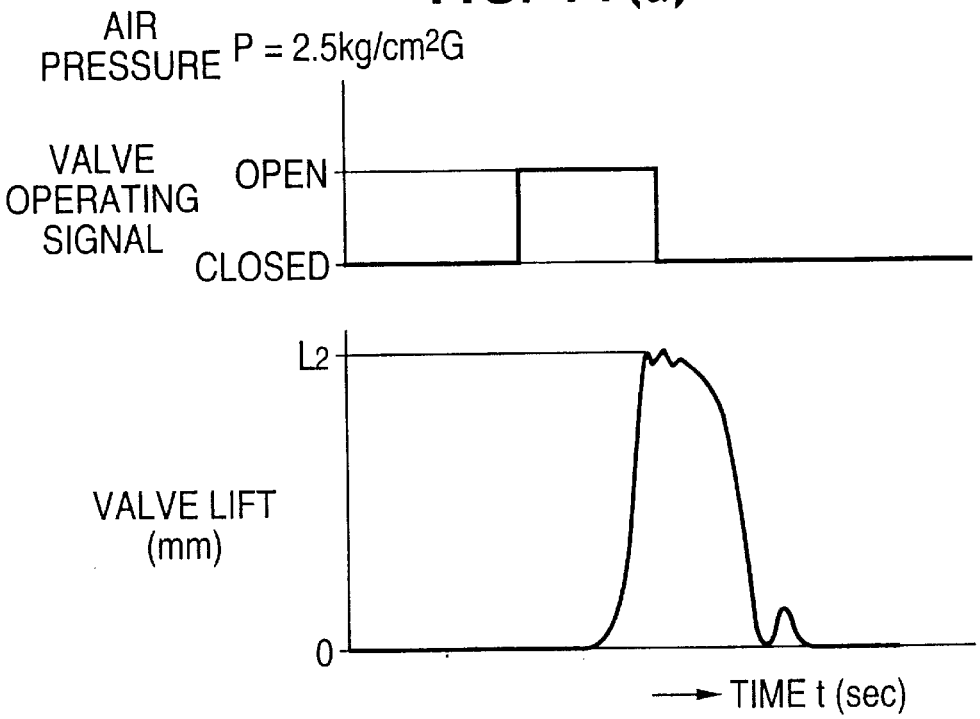
FIGS. 11(*a*) and 11(*b*) are graphs showing the lift waveform of the valve body of the air-fuel mixture valve.
Figure 11B:
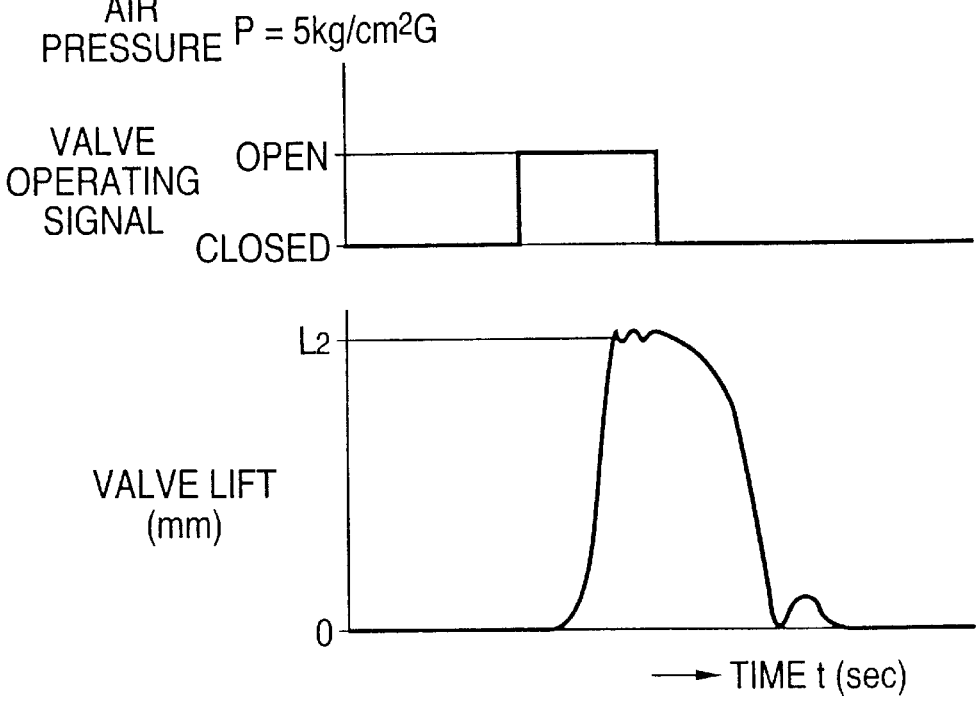

FIGS. 11(*a*) and 11(*b*) are a second set of graphs showing the lift of the valve body of the air-fuel mixture valve. In these figures, the abscissa and ordinate denote time t (seconds) and lift of the valve body, respectively. FIG. 11(*a*) shows the lift waveform when the pressure P of the compressed air is 2.5 kg/cm$^2$G, while FIG. 11(*b*) shows the lift waveform when the pressure P is 5 kg/cm$^2$G.

Referring to FIGS. 10(*a*), 10(*b*), 11(*a*) and 11(*b*), the maximum lift is $L_2$(mm). The valve body takes a long time to open the air-fuel mixture valve 70 in FIGS. 10(*a*) and 10(*b*) compared with FIGS. 11(*a*) and 11(*b*). Therefore, it is possible to control the period for the valve body 81*a* to open the air-fuel mixture valve 70 by appropriately determining the pressure P of the compressed air, magnetic force of the electromagnetic coil 73, load applied to the spring 84, and so on.

The larger the pressure P as in the cases shown in FIGS. 10(*b*) and 11(*b*), the more slowly the lift is reduced after the valve operating signal to open the valve is changed to the valve operating signal to close the valve. This is because the larger the pressure P, the longer the spring 84 takes to return to its original state. Therefore, the load applied to the spring 84 has to be determined taking the pressure P into consideration.

In the foregoing embodiment, the compressed air supply system 20 in FIG. 1 may be configured such that the main fuel injection valve 31 is connected to the primary side of the air pump 25, and the air-fuel mixture composed of the fuel supplied via the main fuel injection valve 31 and the compressed air is supplied to the accumulator 21. In such a case, there is no need for the accumulator 21 to have the main fuel injection valve 31.

The present invention is advantageous in that the magnetic force applied to the electromagnetic coil is determined on the basis of the relationship defined by $Fm \geqq Fv - fa$, where Fm denotes the axial tension caused by the magnetic force of the electromagnetic coil, Fv denotes the force required to open and close the empty air-fuel mixture valve, and fa denotes the force required for the compressed air to open the air-fuel mixture valve. Therefore, it is possible to use the pressure of the compressed air in order to open the air-fuel mixture (i.e., to move the core to open the valve). This is effective in reducing the magnetic force of the electromagnetic coil, and making the electromagnetic coil compact. Further, the whole air-fuel mixture valve can be made compact and light in weight. Power consumption of the electromagnetic coil is reduced, which is effective in allowing the battery to have a reduced capacity. In addition, the circuit for activating the electromagnetic coil and the wiring (power supply system) can have smaller capacity, and be made less expensive. When the electromagnetic coil having the magnetic force similar to that of conventional electromagnetic coils is used, the force for opening the air-fuel mixture valve can be increased by the amount of the auxiliary power, so that the open area of the air-fuel mixture valve can be enlarged to increase an amount of the air-fuel mixture to be injected.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. In an air-fuel mixture valve where a valve stem is moved via a core moved with magnetic force of an electromagnetic coil in order to open the air-fuel mixture valve and supply an air-fuel mixture to combustion chambers of an internal engine, a method of determining the magnetic force of the e lectromagnetic coil on the basis of the relationship defined by $Fm \geqq Fv - fa$, where Fm denotes axial tension depending upon the magnetic force of the electromagnetic coil, Fv denotes a force necessary for opening and closing the empty air-fuel mixture valve, and fa denotes force for compressed air to open the air-flel mixture valve.

2. An air-fuel mixture valve comprising:

a valve assembly;

a valve body located within said valve assembly and movable between a closed position and an open position;

an electromagnetic coil surrounding said valve body for moving said valve body from said closed position to said open position; and air pressure means for providing an air pressure force to said valve body to assist said electromagnetic coil in moving said valve body to said open position.

3. The air-fuel mixture valve according to claim 2, further comprising means for biasing said valve body to said closed position.

4. The air-fuiel mixture valve according to claim 3, wherein said valve body includes a stem having a hollow interior through which an air-fuel mixture may pass.

5. The air-fuel mixture valve according to claim 4, wherein said valve body further includes a plurality of partially radially oriented discharge openings in communication with said hollow interior.

6. The air-fuel mixture valve according to claim 5, wherein said valve body includes an electromagnetic core attached thereto and movable therewith.

7. The air-fuel mixture valve according to claim 6, wherein said valve assembly includes an accumulating chamber therein located at one end of said valve body for accumulating a quantity of compressed air therein which provides said air pressure force.

8. The air-fuel mixture valve according to claim 2, wherein said valve body includes a stem having a hollow interior through which an air-fuel mixture may pass.

9. The air-fuel mixture valve according to claim 8, wherein said valve body further includes a plurality of partially radially oriented discharge openings in communication with said hollow interior.

10. The air-fuel mixture valve according to claim 9, wherein said valve body includes an electromagnetic core attached thereto and movable therewith.

11. The air-fuel mixture valve according to claim 10, wherein said valve assembly includes an accumulating chamber therein located at one end of said valve body for accumulating a quantity of compressed air therein which provides said air pressure force.

12. The air-fuel mixture valve according to claim 2, wherein said valve body includes an electromagnetic core attached thereto and movable therewith.

13. The air-fuel mixture valve according to claim 12, wherein said valve assembly includes an accumulating chamber therein located at one end of said valve body for accumulating a quantity of compressed air therein which provides said air pressure force.

14. The air-fuel mixture valve according to claim 2, wherein said valve assembly includes an accumulating chamber therein located at one end of said valve body for accumulating a quantity of compressed air therein which provides said air pressure force.

15. A method of operating a valve comprising the following steps:

providing a valve assembly having a reciprocatable valve body therein;

providing an electromagnetic coil surrounding said valve body;

biasing said valve body in a first closed direction of said valve;

providing an air pressure force to said valve body in a second direction opposite to said first direction; and energizing said electromagnetic coil to thereby move said valve body in said second direction to open said valve.

16. The method of claim 15, wherein said step of energizing said electromagnetic coil further includes the steps of:

determining an opening force necessary to open said valve body in the absence of said air pressure force;

determining an amount of said air pressure force; and calculating a minimum axial force to be provided by said electromagnetic coil by subtracting said amount of air pressure force from said opening force.

17. The method of claim 15, wherein said step of providing a valve assembly having a reciprocatable valve body therein includes the step of providing an air-fuel mixture valve assembly.

18. The method of claim 15, wherein said step of providing said reciprocatable valve body includes the step of providing said valve body with a stem having a hollow interior through which an air-fuel mixture may pass.

19. The method of claim 18, wherein said step of providing said valve body with a stem includes the step of providing said valve body with a plurality of partially radially oriented discharge openings in communication with said hollow interior.

20. The method of claim 15, further comprising the step of providing said valve assembly with an accumulating chamber therein located at one end of said valve body for accumulating a quantity of compressed air therein which provides said air pressure force.

* * * * *